US005308306A

United States Patent [19]

Wang

[11] Patent Number: 5,308,306

[45] Date of Patent: May 3, 1994

[54] ABDOMEN EXERCISING APPARATUS

[75] Inventor: Leao Wang, Taichung Hsien, Taiwan

[73] Assignee: Greenmaster Ind. Corp., Taichung Hsien, Taiwan

[21] Appl. No.: 992,730

[22] Filed: Dec. 18, 1992

[51] Int. Cl.[5] ..... A63B 26/00

[52] U.S. Cl. ..... 482/142; 482/133; 482/121

[58] Field of Search ..... 482/142, 133, 121, 122, 482/134–136, 140, 92, 123, 130, 148

[56] References Cited

U.S. PATENT DOCUMENTS

| | | | |
|---|---|---|---|
| 5,005,830 | 4/1991 | Jones | 482/134 |
| 5,070,863 | 12/1991 | McArthur et al. | 482/1 |
| 5,100,131 | 3/1992 | Fong | 482/112 |
| 5,110,121 | 5/1992 | Foster | 482/137 |
| 5,110,122 | 5/1992 | Moore et al. | 482/134 |

FOREIGN PATENT DOCUMENTS

| | | | |
|---|---|---|---|
| 0121902 | 10/1984 | European Pat. Off. | 482/121 |

*Primary Examiner*—Richard J. Apley
*Assistant Examiner*—Jerome Donnelly
*Attorney, Agent, or Firm*—Bacon & Thomas

[57] ABSTRACT

An abdomen exercising apparatus is disclosed having a back rest supported on two curved supports at two opposite sides of a base thereof by two cranks and two elastic elements, which elastic elements are respectively connected between the curved supports and the cranks to constantly pull up the cranks for permitting the back rest to be disposed at a top position perpendicular to a cushion on the base. The back rest is moved backwards to a bottom position closely attached in line with the cushion as the player sits on cushion and then lies down, and automatically pulled up to the top position by the elastic elements through the cranks as the player sits up. Metal fixing rods may be connected between the curved supports and the cranks to fix the back rest in position.

2 Claims, 5 Drawing Sheets

ABDOMEN EXERCISING APPARATUS

BACKGROUND OF THE INVENTION

The present invention is relates to an abdomen exercising apparatus which uses elastic elements to provide an upward strength in helping the player sit up with less effort.

A variety of exercising apparatus have been proposed for use in exercising the muscles of the abdomen, and have appeared on the market. An ordinary exercising apparatus, as shown in FIG. 1, is simply comprised of an abdominal board supported on two opposite stands of different heights. As the abdominal board is tilted when installed, much effort should be applied when sitting up. Therefore, this structure is not suitable for fat persons and the aged.

FIGS. 2 and 3 illustrate two different structures of exercising apparatus which can be used for exercising the muscles of the abdomen as well as for other purposes. These two exercising apparatus commonly have a abdominal board that can be adjusted to the horizontal position for exercising the muscles of the abdomen. The abdominal board of the structure of exercising apparatus shown in FIG. 3 can be folded up and supported in the vertical position to support the user's back for permitting the use to sit on the apparatus in doing other exercises. Therefore, these two exercising apparatus give little help to, and fat and old persons.

SUMMARY OF THE INVENTION

The present invention has been accomplished under the aforesaid circumstances. It is therefore an object of the present invention to provide an abdomen exercising apparatus which produces an upward force to help the user sit up. It is another object of the present invention to provide an abdomen exercising apparatus which prevents the user from shifting the back while doing the exercise of sit-up.

According to one aspect of the present invention, the abdomen exercising apparatus is generally comprised of a base supported between two opposite stands, a cushion supported on the base at the front, and a back rest supported on two curved supports at two opposite sides of the base by two cranks and two elastic rubber rods, wherein the elastic rubber rods are respectively connected between the curved supports and the cranks to constantly pull up the cranks for permitting the back rest to be disposed at a top position perpendicular to the cushion. The back rest is pushed upwards by the cranks to give the user an upward force as the user is sitting up. Therefore, the user can sit up with less effort.

According to another aspect of the present invention, the curved supports and the cranks are respectively curved upwards so that the joints between the curved supports and the cranks are disposed at a height above the cushion near the hipjoints of the user. Therefore, the user does not shift the back while sitting up.

According to still another aspect of the present invention, metal fixing rods may be connected between the curved supports and the cranks to fix the back rest in position for permitting the apparatus to be used for other purposes.

DETAILED DESCRIPTION OF THE PREFERRED EMBODIMENT

Figure 1:
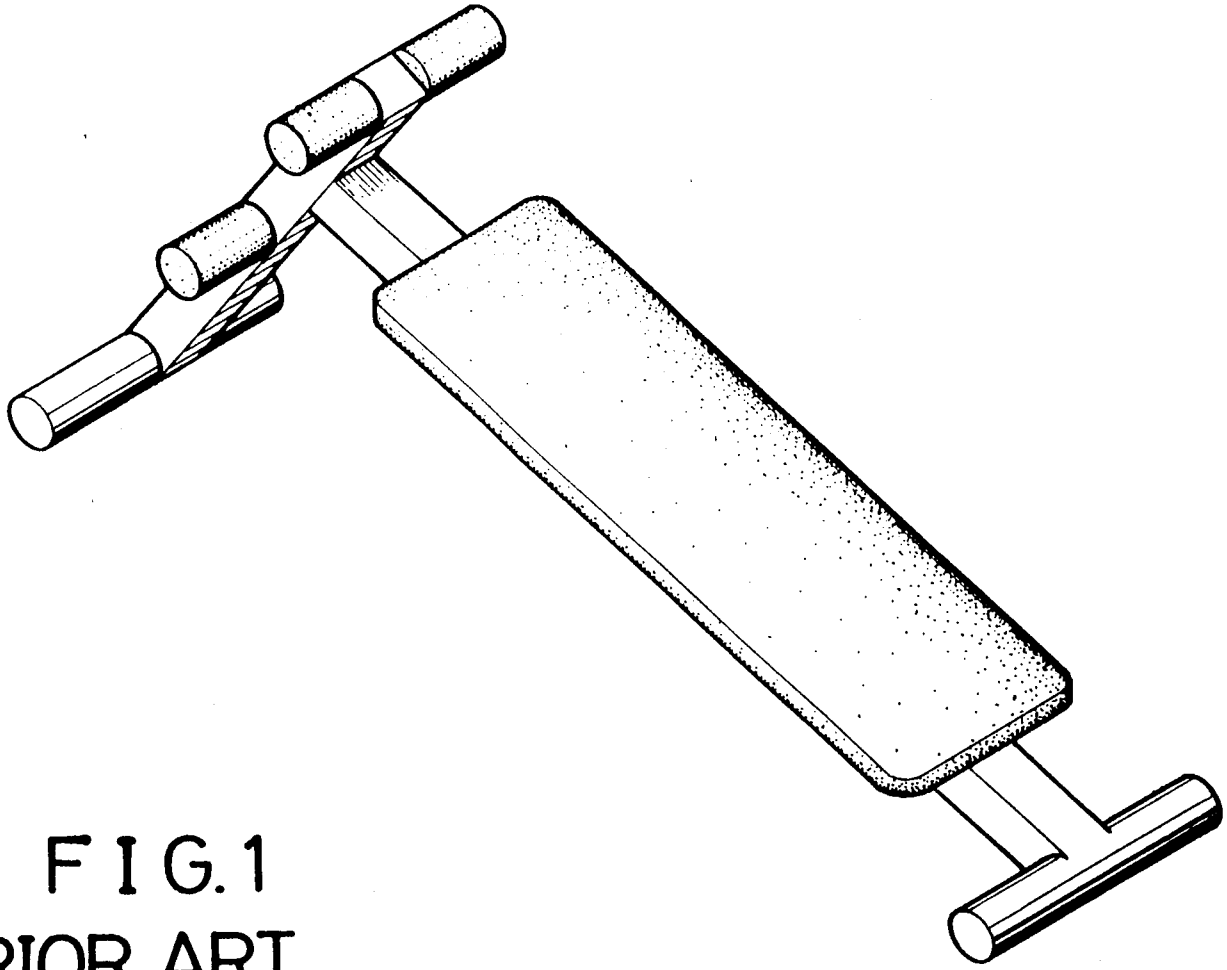
FIG.1 PRIOR ART
FIG. 1 is an elevational view of a conventional abdominal board assembly for training the muscles of the abdomen.
Figure 3:
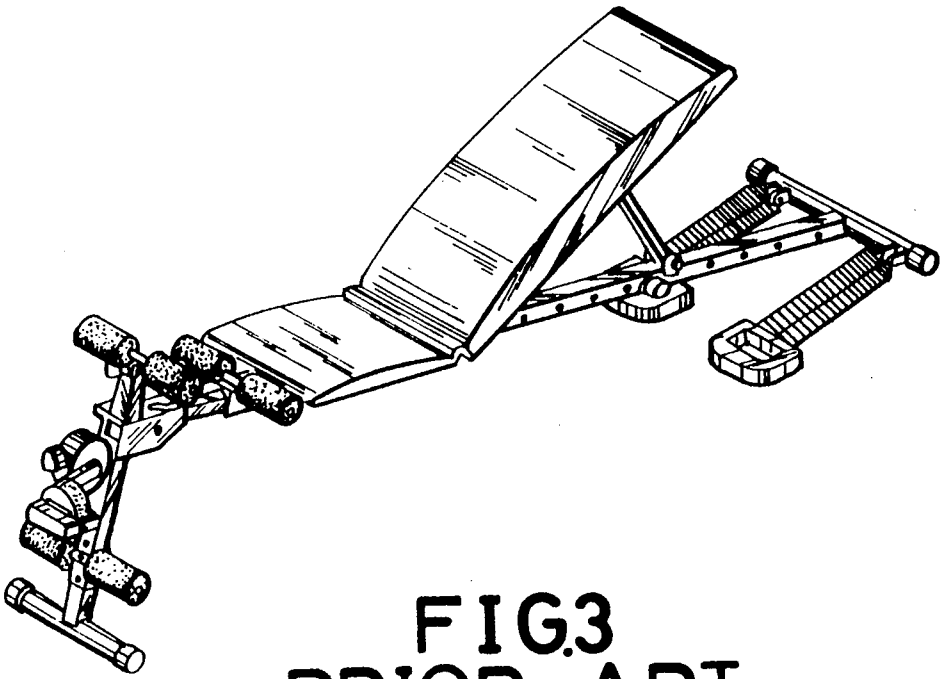
FIG.3 PRIOR ART
FIG. 3 is an elevational view of an abdomen exercising apparatus according to Chinese Patent Publication No. 185,126.
Figure 2:
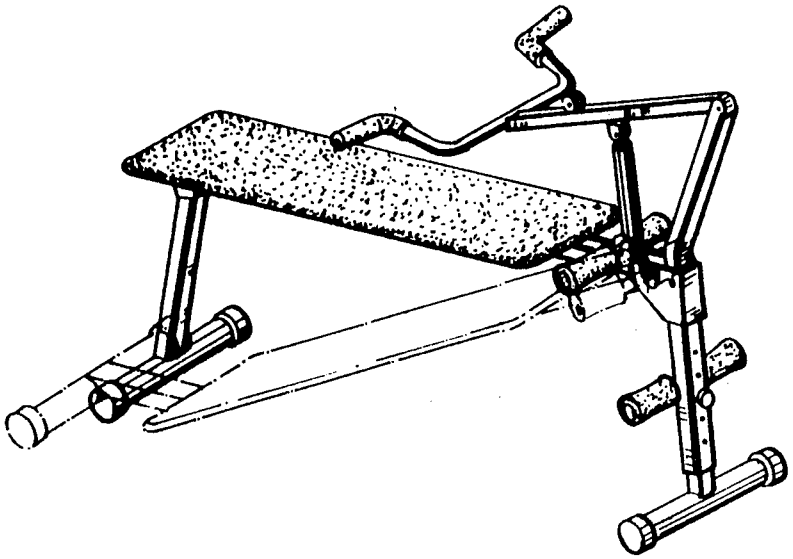
FIG.2 PRIOR ART
FIG. 2 is an elevational view of an abdomen exercising apparatus according to Chinese Patent Publication No. 135,343.
Figure 4:
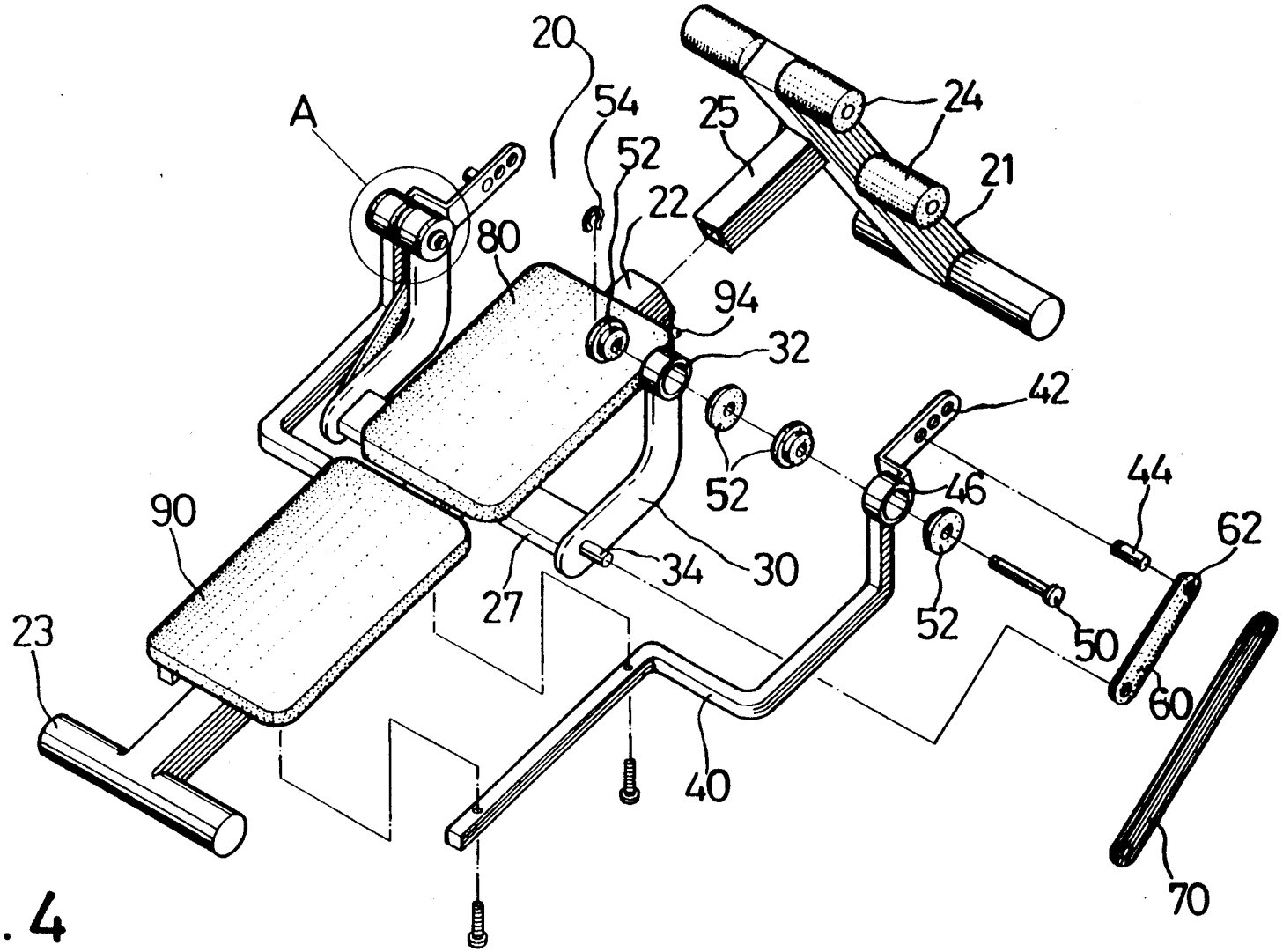
FIG. 4 is an exploded view of an abdomen exercising apparatus according to the present invention.
Figure 5:
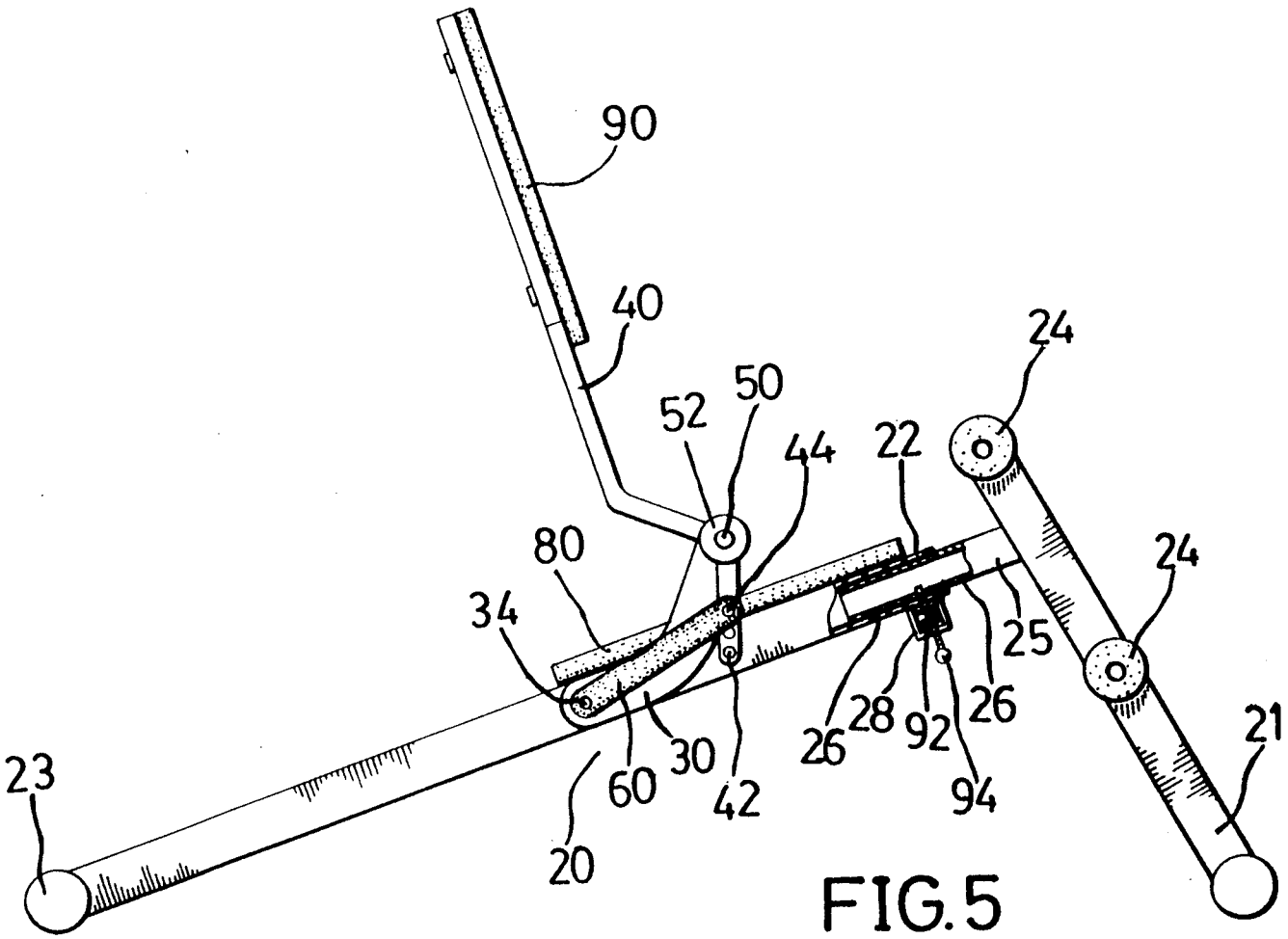
FIG. 5 is a perspective side view of the abdomen exercising apparatus of FIG. 4.

Referring to FIGS. 4 and 5, an abdomen exercising apparatus as constructed in accordance with the present invention is generally comprised of a base 20, a pair of curved supports 30, a pair of cranks 40, two bolts 50, a plurality of elastic rubber rods 60, a plurality of metal fixing rods 70, a cushion 80, a back rest 90, a spring 92, and a spring latch 94.

Figure 6:
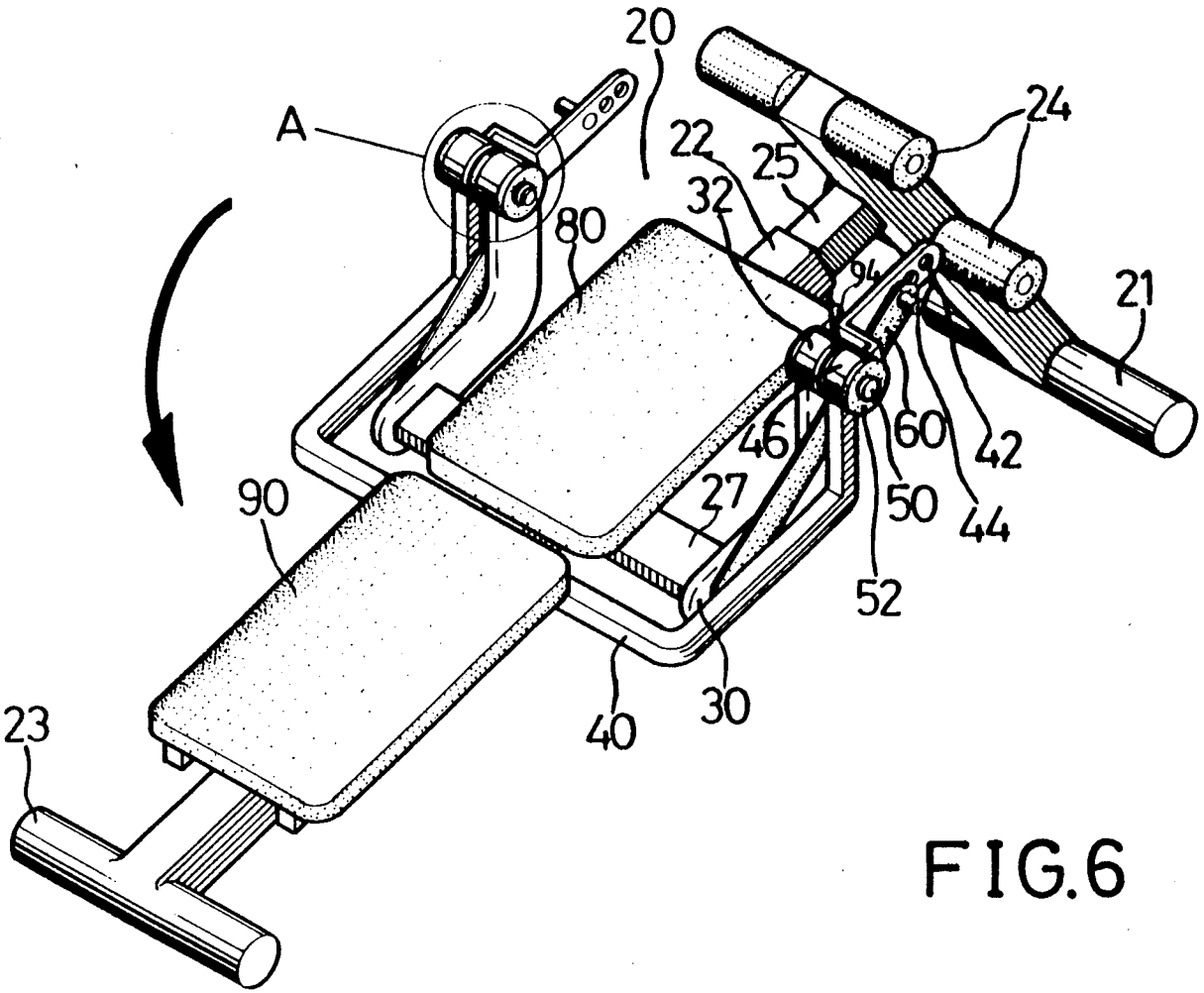
FIG. 6 is an elevational view of the abdomen exercising apparatus of FIG. 4.

The base 20 comprises an elongated, hollow master rod 22 connected between a front stand 21 and a rear stand 23. The front stand 21 has pairs of cross rods 24 respectively aligned at different levels in transverse direction, which are respectively covered with a covering of elastic rubber or the like, and a back rod 25 extended backwards in longitudinal direction at a suitable level and fitted into a longitudinal hole (not shown) through the master frame 22. The back rod 25 has a row of through holes 26 aligned in longitudinal direction for lock control. The master rod 22 has a cross bar 27 at the middle and a circular holder frame 28 at the bottom adjacent to the front end thereof. The cushion 80 is fastened to the master rod 22 at the top near the front stand 21. The curved supports 30 are symmetrically welded to the cross bar 27 at two opposite sides. Each curved support 30 has a front end curved upwards and terminated to a barrel 32, and a rear end welded to the cross bar 27 at either end and made with a pin 34 at an outer side. The cranks 40 fit over the curved supports 30 respectively. Each crank 40 has a series of screw holes 42 at one end, into which a screw rod 44 may be alternatively threaded, a barrel 46 pivotally connected to the barrel 32 of either curved support 30 by bolt 50, bushings 52 and C-shaped retainer 54. The rear part of each crank 40 is fastened to the back rest 90. Two elastic rubber rods 60, which have each two pin holes 60 at two opposite ends, are respectively connected between the screw rod 44 on either crank 40 and the pin 34 on the matching curved support 30. When connected, the back rest 90 is carried by the crank 40 to a vertical position relative to the cushion 80 (see FIG. 5). The tensile strength of the elastic rubber rods 60 is designed much lower than the body weight of a person. As an user sits on the cushion 80 and then rests the back on the back rest 90, the back rest 90 is forced backwards slowly and then situated over the master rod 22 (see FIG. 6). When sitting up, the elastic rubber rods 60 pull the cranks 40 in carrying the back rest 90 upwards. Therefore, the user needs less effort to sit up. This arrangement is very helpful to the beginners and the persons of less strength. The tensile strength of the elastic rubber rods 60 may be designed according to different requirements, or elastic rubber rods 60 of different tensile strength may be alternatively used. The apparatus may also be used without the elastic rubber rods 60. The curved supports 30 and the cranks 40 are designed curved upwards for permitting the pivots A (see FIG. 5) to be disposed at an elevation above the cushion 80 close to the user's hipjoints, and therefore the user is prevented from shifting the back in the back rest 90 as the back rest 90 is alternatively moved to and fro.

Referring to FIG. 5 again, a spring latch 90 is retained in the circular holder frame 28 by a spring 92. Once the back rod 25 was inserted into the master rod 22, the spring latch 90 is inserted into either through hole 26 on the back rod 25 of the front stand 21. Therefore, the distance between the pivots A and the cross rods 24 of the stand 21 can be conveniently adjusted according to length of the user's legs.

Furthermore, metal fixing rods 80 may be used to replace the elastic rubber rods 60 and connected between the curved supports 30 and the cranks 40 for permitting the back rest 90 to be fixed at the desired angular position, and therefore the apparatus can be used in weightlifting or dumbbell exercising.

What is claimed is:

1. An abdomen exercising apparatus comprising an elongated master rod connected between a front stand and a rear stand, said master rod having a cross bar at the middle, a cushion fastened to said master rod at the top near said front stand, two curved supports respectively connected to said cross bar at two opposite sides relative to said cushion, a back rest movably supported on said curved supports by two cranks and two elastic elements, wherein said curved supports have each a front end curved upwards and terminated to a barrel and a rear end welded to either end of said cross bar and made with a pin at an outer side; said cranks have each a series of screw holes at one end alternatively fastened with a screw rod, a barrel near the screw holes pivotally connected to the barrel on either curved support by a bolt, a set of bushings and a retainer, and a rear part fastened to said back rest at the bottom; said elastic elements are detachably connected between said curved supports and said cranks to automatically pull said back rest to a top position perpendicular to said cushion, each elastic element having one end connected to the screw rod on either screw hole on either crank and an opposite end connected to the pin on the curved support at the same side; said back rest is moved backwards to a bottom position closely attached to said master rod in line with said cushion as the player sits on said cushion and then lies down; said back rest is pulled upwards to said top position by said elastic elements through said cranks as the player sits up.

2. The abdomen exercising apparatus of claim 1 wherein two metal fixing rods may be respectively fastened between said curved supports and said cranks to replace said elastic elements for permitting said back rest to be maintained at a fixed angle relative to said base.

* * * * *